United States Patent [19]

Manharth et al.

[11] Patent Number: 4,483,661

[45] Date of Patent: Nov. 20, 1984

[54] BLADE ASSEMBLY FOR A TURBOMACHINE

[75] Inventors: Gary B. Manharth, Milford; Jay L. Cornell, Cincinnati, both of Ohio

[73] Assignee: General Electric Company, Cincinnati, Ohio

[21] Appl. No.: 490,820

[22] Filed: May 2, 1983

[51] Int. Cl.[3] ..... F01D 5/32

[52] U.S. Cl. ..... 416/220 R; 416/221

[58] Field of Search ..... 416/220 R, 220 A, 193 A, 416/221, 146 R

[56] References Cited

U.S. PATENT DOCUMENTS

| | | | |
|---|---|---|---|
| 3,572,970 | 3/1971 | Smuland | 416/221 |
| 3,666,376 | 5/1972 | Damus | 416/220 R |
| 3,734,646 | 5/1973 | Perkins | 416/220 |
| 3,930,751 | 1/1976 | Straslicka et al. | 416/220 |
| 3,955,898 | 5/1976 | Zaehring | 416/215 |
| 4,108,571 | 8/1978 | Mawson | 416/221 |
| 4,192,633 | 3/1980 | Herzner | 416/221 |

*Primary Examiner*—Stephen Marcus
*Assistant Examiner*—John Kwon
*Attorney, Agent, or Firm*—Gregory A. Welte; Derek P. Lawrence

[57] ABSTRACT

Gas turbine engines are used as powerplants for aircraft. When the aircraft are parked on the ground, the wind can blow through the engines and set fans and rotors into motion, i.e., windmill them. Given that the blades of the fans and rotors are loosely fastened to their rotors, the low speed rotation caused by windmilling causes the blades to clatter or clank, thus causing wear. The present invention provides means for clamping blades into position during this low speed rotation for reducing clanking.

19 Claims, 6 Drawing Figures

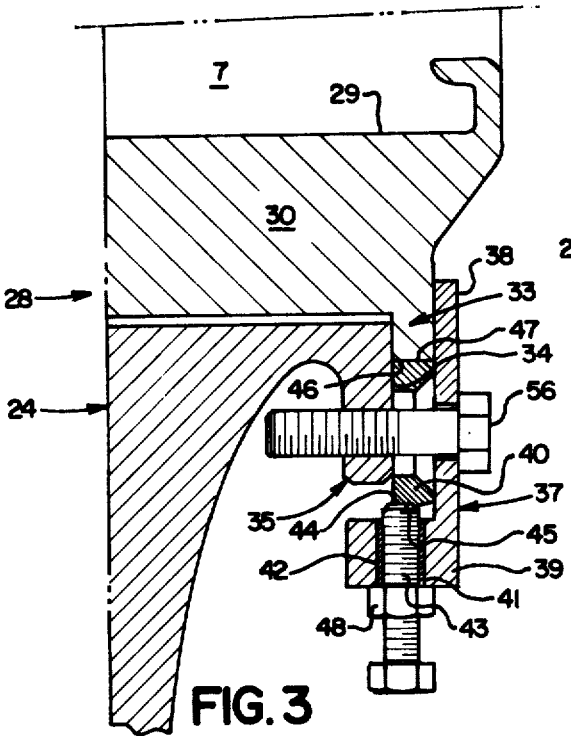
FIG. 3
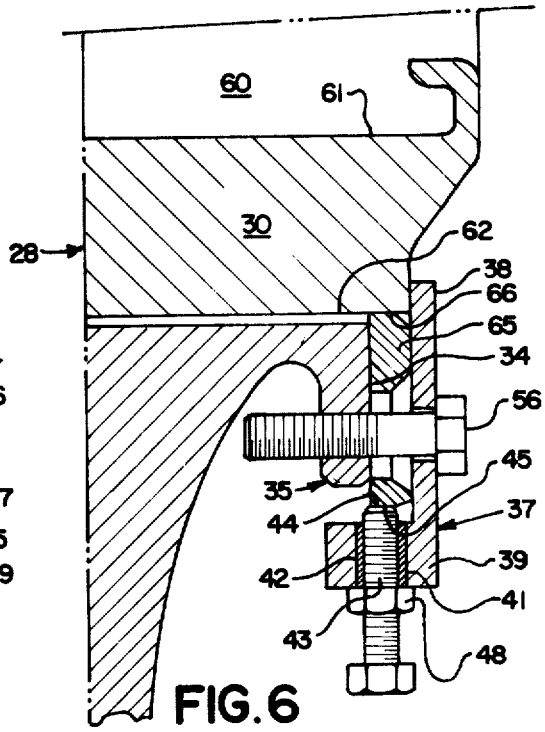
FIG. 6
FIG. 4
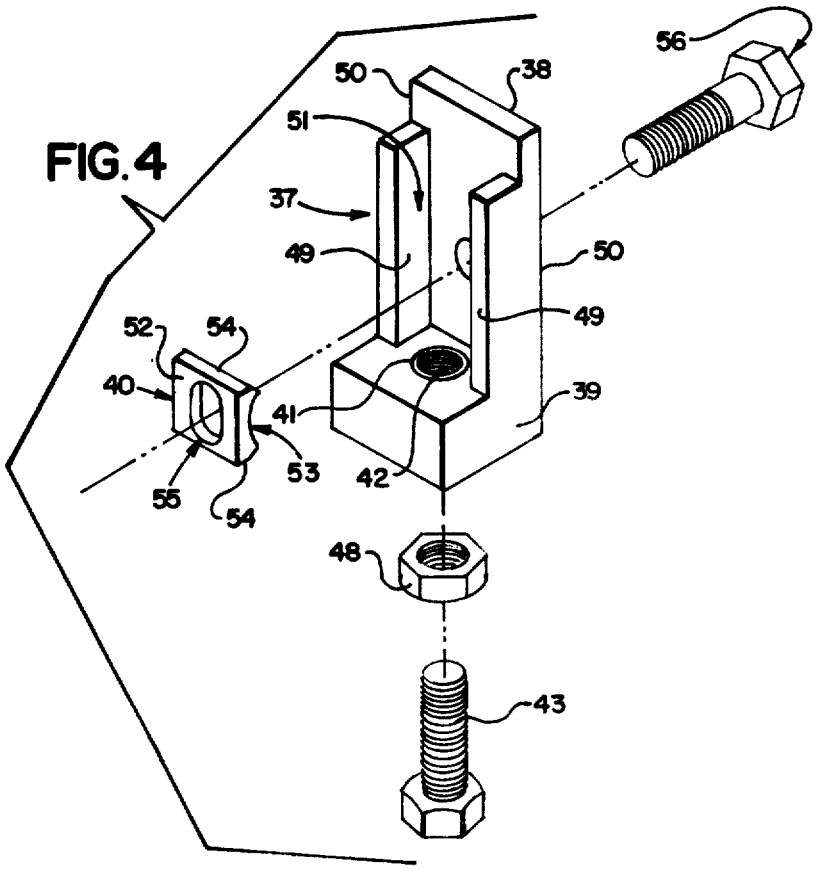

BLADE ASSEMBLY FOR A TURBOMACHINE

The U.S. Government has rights in this invention pursuant to Contract No. F 41608-81-C-A211 awarded by the Department of the Air Force.

BACKGROUND OF THE INVENTION

The present invention relates generally to turbomachinery, and more particularly, to an assembly for attaching blades to an associated rotor of the turbomachine.

Generally, a turbomachine will include series of blades attached to a rotor which is axially disposed within an outer casing. To retain the blades to the rotor, the base of each blade is provided with a dovetail portion and the rotor is provided with a series of slots which are correspondingly configured to the dovetail portion of the blades. In assembly, the dovetail portion of the blade is located within a slot of the rotor, and the assembly is appropriately secured in position, for example, using a retaining ring.

To facilitate assembly of the unit, as well as subsequent repairs, a clearance is provided between the dovetails of the blades and the slots of the rotor. Although helpful during assembly and servicing of the turbomachine, such tolerances tend to permit relative motion between the blades and rotor when assembled. In many cases, this motion may be maintained to an acceptable level. However, particular difficulty in this regard has been encountered in connection with the blades associated with the fan portion of the turbomachine, since these blades are traditionally significantly longer than the blades associated with the remaining portions of the turbomachine.

Problems associated with fan blade motion have long been recognized, and steps have been taken to ameliorate these problems. For example, fan blades are often provided with cooperating surfaces or protrusions which combine and cooperate to develop what are known as "interlocking blade shrouds". Properly configuring the series of protruding surfaces associated with the blades has been found to limit blade motion or rotation resulting from clearances between the dovetail of the blade and the slot which engages it.

Although reducing unwanted blade motion in many cases, particular difficultly has been found in connection with movement resulting from ambient wind conditions and the effects of such conditions upon a non-operating turbomachine. Such ambient wind conditions, passing through the various portions of the turbomachine and encountering the associated series of blades, tend to produce an effect known as "wind-milling", resulting in movement of the rotor within the turbomachine. In connection with this wind-milling effect, a phenomenon known as "clanking" often occurs, wherein the blades rotate within the slots of the rotor during wind-milling. Again, in view of their length, this phenomenon is particularly prevalent in connection with fan blades. Such blade motion can eventually lead to premature wear and subsequent failure along various portions of the blade, particularly along the blade dovetail and the protrusions which combine to develop the interlocking blade shroud, as well as in connection with the structure which is used to retain the blades to the rotor.

Recognizing this problem, workers skilled in the art have attempted to overcome the problems associated with clanking in an effort to reduce fatigue and possible failure of blade components. Examples of this may be found, for example, in U.S. Pat. Nos. 3,930,751 and 3,572,970. However, neither of these solutions have been found to be entirely satisfactory and it therefore remains to develop an anti-clanking assembly which is effective in overcoming the foregoing disadvantages.

SUMMARY OF THE INVENTION

It is therefore a primary object of the present invention to provide a means for preventing relative motion between the blade and rotor of a turbomachine.

It is also an object of the present invention to provide a means for preventing such relative motion over extended periods of time.

It is also an object of the present invention to provide a means for preventing such relative motion which is adapted for use in connection with different types of turbomachines.

It is also an object of the present invention to provide a means for preventing such relative motion which does not require alteration of the blades and rotor of the turbomachine.

It is also an object of the present invention to provide a means for preventing such relative motion which readily permits installation and repair of the blades, as needed.

These and other objects are achieved in accordance with one form of the present invention by providing the mechanism which is used to retain the blade to the rotor with adjustment means capable of developing a substantially radially outwardly directed force for application against the blade, to securely retain the dovetail of the blade within the slot of the rotor without adversely affecting the alignment between these structural elements.

For further detail regarding the present invention, reference is made to the following detailed description of preferred embodiments, taken in conjunction with the following illustrations.

BRIEF DESCRIPTION OF THE DRAWINGS

FIG. 3 is a partial, cross-sectional view of the interface between one of the blades and the rotor illustrated in FIG. 2, at III.

FIG. 4 is an exploded view of the retaining means illustrated in FIG. 3.

FIG. 6 is a partial, cross-sectional view similar to that of FIG. 3, illustrating an alternative embodiment of the retaining means of the present invention.

In the several views provided, like reference numerals denote similar structure.

DETAILED DESCRIPTION OF THE INVENTION

Figures 1, 2:
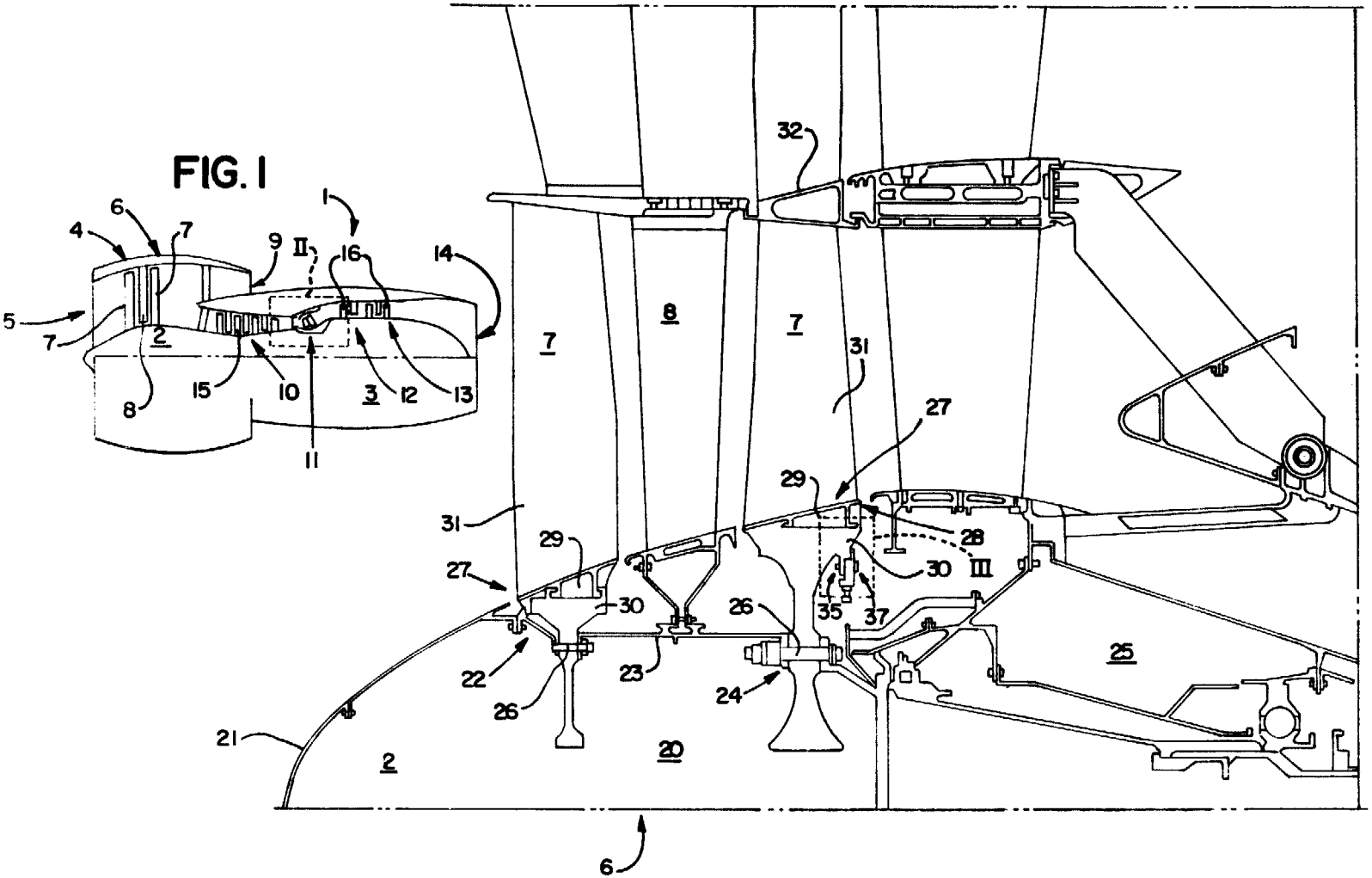
FIG. 1 is a side elevational view of a turbomachine, portions of which have been broken away to show internal construction detail.
FIG. 2 is a partial, cross-sectional view of the fan portion of the turbomachine illustrated in FIG. 1, at II.

Although specific forms of the invention have been selected for illustration in the drawings, and the following description is drawn in specific terms for the purpose of describing these forms of the invention, this description is not intended to limit the scope of the invention which is defined in the appended claims.

FIG. 1 generally illustrates the components comprising a conventional turbomachine 1, which includes a rotor 2 axially disposed within a casing 3, and a cowling 4 disposed about forward portions of the casing 3 and extending over forward portions of the rotor 2. Air received through the forward opening 5 of the cowling 4 passes between the cowling 4 and rotor 2 and through a first, fan portion 6 which includes series of blades 7 associated with the rotor 2 and series of vanes 8 associated with the cowling 4. A portion of this air is discharged through an annular opening 9 developed between the cowling 4 and casing 3, while the remainder of this air is circulated between the rotor 2 and casing 3, for delivery to a compressor portion 10. Compressed air is delivered from the compressor portion 10 to a combustion system 11, whereupon an ignited mixture of fuel and air is directed through subsequent turbine portions 12, 13 and discharged through an aft nozzle 14.

As is conventional, the fan portion 6, compressor portion 10 and turbine portions 12, 13 each include series of blades 7, 15, 16, respectively, which are attached to respective portions of the rotor 2 in conventional manner. It will be understood that the turbomachine 1 previously described has only been provided as an illustrative example and that the present invention has applicability in connection with a variety of turbomachines other than the example described.

Referring to FIG. 1, it will be noted that the blades 7 associated with the fan portion 6 of the turbomachine 1 are substantially longer than the blades 15, 16 associated with other portions of the turbomachine. For this reason, as previously described, the potential for unwanted motion of the blades 7 is greater than the potential for unwanted motion of the blades 15, 16, and the remaining description is therefore primarily directed to use of the present invention in connection with fan blades. However, it will be understood that the present invention also finds applicability in connection with other blades of the turbomachine 1, as well as other turbomachines which have not been specifically described.

Referring now to FIG. 2, a more detailed illustration of the fan portion 6 of the turbomachine 1 is provided. As illustrated, and as is conventional, the portion 20 of the rotor 2 which is associated with the fan portion 6 generally comprises an assembly of components including, in part, a spinner cap 21, a first disk 22, a spacer 23, a second disk 24, and a rear shaft 25. Each of these respective components are assembled to form a unit using series of bolts 26 or other appropriate fasteners. The periphery 27 of each disk 22, 24 is provided with a series of axially oriented slots 28 for receiving the blades 7. Of course, it will be understood that the number of slots 28 associated with each disk 22, 24, in addition to the configuration and precise orientation of each slot 28, will vary in accordance with a particular application. However, irrespective of the application involved, each slot 28 is generally provided with lateral faces which incorporate a series of peaks 70 and valleys 71 (best illustrated in FIG. 5) which combine to engage a blade 7 as will be more fully described below.

With further reference to FIG. 2, each blade 7 generally includes a base 29 having a dovetail portion 30 for engaging the slot 28 of a disk 22, 24, and an airfoil portion 31 which extends generally radially outwardly from the disk 22, 24 to which the blade 7 is attached. The lateral faces of the dovetail 30 of each blade 7 also incorporate a series of peaks 72 and valleys 73 (best illustrated in FIG. 5) which are configured to correspond to the peaks 70 and valleys 71 of the slot 28. In this manner, by inserting the dovetail 30 within the slot 28 of a disk 22, 24, engagement between the blade 7 and disk 22, 24 is established. As previously mentioned, to facilitate installation and servicing, a clearance 74 (best illustrated in FIG. 5) is generally provided between the slot 28 and dovetail 30.

Again referring to FIG. 2, the blade 7 associated with the disk 24 further incorporates a mid-span platform 32 extending outwardly from the airfoil 31 of the blade approximately half way along the length of the blade. It will be understood that each blade 7 associated with the disk 24 will also include mid-span platforms 32 extending outwardly from each side of the airfoil 31 as shown. By providing each mid-span platform 32 with a length equal to approximately one half the distance between adjacent blades 7, upon assembly of the blades 7 the mid-span platforms 32 will combine to develop an interlocking blade shroud comprised of mid-span platforms.

Figure 5:
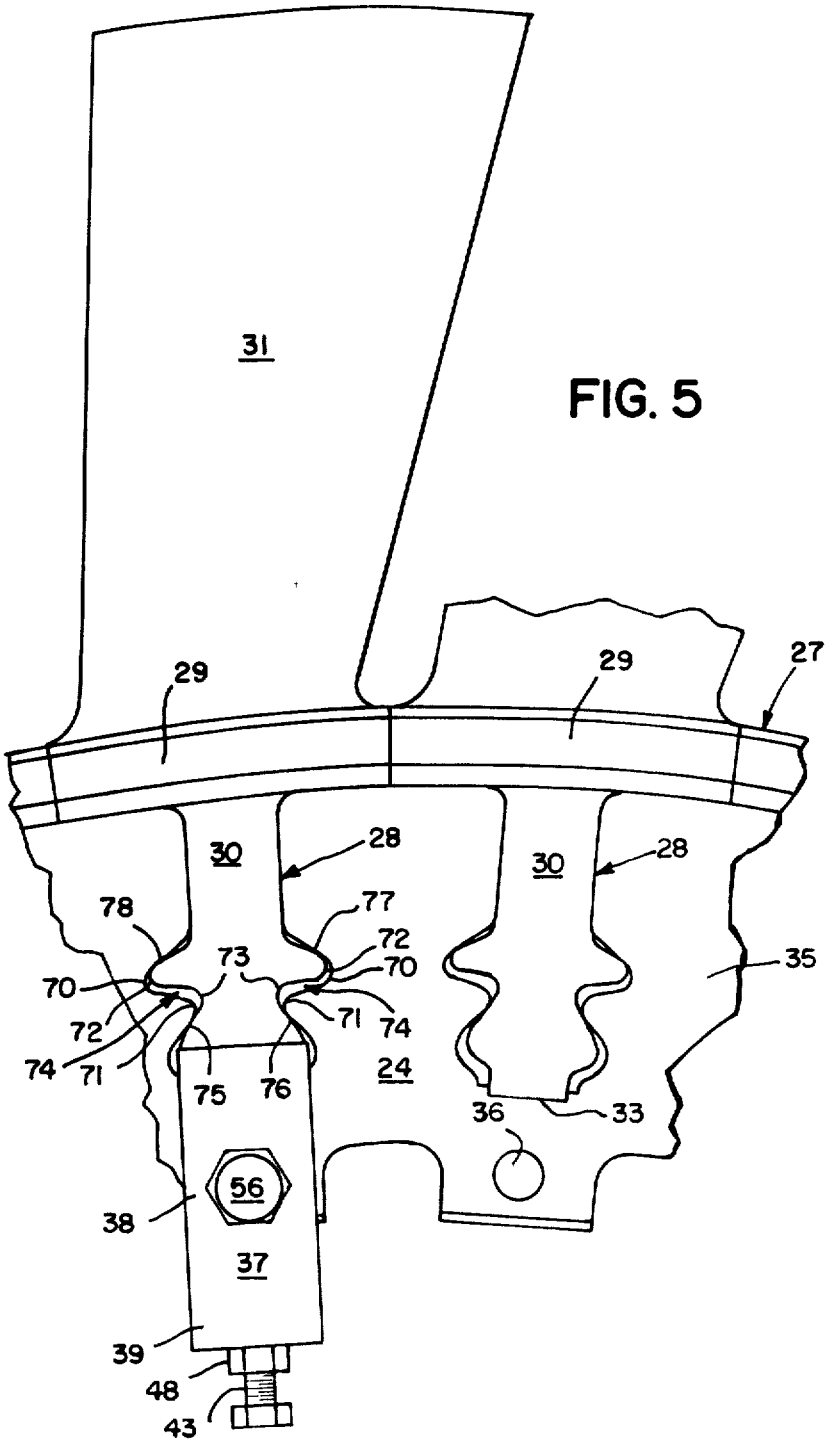
FIG. 5 is a rear elevational view illustrating a blade assembly which uses the retaining means illustrated in FIGS. 3 and 4.

In encountering the effects of wind-milling, it has been found that such blades 7 tend to experience motion or rotation which displaces them from their normal position, primarily as a result of the clearance 74 provided between the slot 28 of the disk and the dovetail 30 of the blade (best illustrated in FIG. 5). Although the shroud comprised of mid-span platforms 32 previously described serves to minimize this movement somewhat, such an assembly has still been found to exhibit a tendency toward wear which can cause fatigue or possible failure after long periods of exposure to wind-milling conditions. This wear has been found to be particularly prevalent along the mid-span platforms 32, along the faces of the slots 28 of the disks, and at the base 29 and dovetail 30 of the blades.

Referring to FIGS. 3–5, and in accordance with one form of the present invention, a means for reducing unwanted blade motion relative to the disk is provided to reduce the potential for fatigue and failure. In the embodiment illustrated, each blade 7 has been provided with a blade hook 33 which extends radially inwardly from the aft edge of the base 29, and along lateral face portions 34 of a rim 35 associated with the disk 24. As is best illustrated in FIG. 5, the rim 35 of the disk 24 is provided with a series of spaced apertures 36 which are capable of receiving the blade retaining means of the present invention, as will be described below.

The blade retaining means illustrated generally comprises a retainer 37 having a bearing portion 38 and a base portion 39 forming an angle with the bearing portion 38, preferably a 90° angle. The bearing portion 38 is preferably substantially planar and is sized to engage the blade hook 33 so that the blade hook 33 is retained against the rim 35 of the disk 24. Also located between the bearing portion 38 of the retainer 37 and the rim 35 is a thrust member 40, which will be described in greater detail below.

Associated with the base portion 39 of the retainer 37 is an aperture 41, a self-locking insert 42 retained within the aperture 41, and a threaded member such as the bolt 43 engaging the insert 42 as shown. One edge 44 of the thrust member 40 contacts the end 45 of the bolt 43, while the other edge 46 of the thrust member 40 contacts the blade hook 33 along the surface 47. The bolt 43 is further provided with a locking nut 48 which is capable of bearing against the base portion 39 of the retainer 37 to securely maintain the bolt 43 in its desired position.

The retainer 37 also preferably includes a pair of guide members 49 associated with each lateral edge 50 of the retainer 37 and extending longitudinally along the length of each edge 50. Each guide member 49 preferable has a depth substantially equal to the width of the blade hook 33, and the cavity 51 which is bordered by the guide members 49 and the bearing portion 38 is preferably sized to slidingly receive the thrust member 40.

The thrust member 40 may be formed in a variety of different shapes, one simple shape merely having rectangular faces and sides. However, as is best illustrated in FIGS. 3 and 4, a preferred embodiment thrust member 40 has one face 52 which is flat and a second face which incorporates a radius 53, and terminating ends 54 of the thrust member 40 are preferably provided with the chamfers shown. This configuration is preferred to minimize longitudinal stiffness of the thrust member 40 so that blade/disk wear does not alter the adjustment developed using the retaining means of the present invention. Moreover, to reduce stress concentration along the radius 53, it is preferred that the largest radius possible be used. Regardless of the configuration of the thrust member selected for use, centrally disposed portions of the thrust member are provided with an elongated slot 55, as best illustrated in FIG. 4.

In order to mount a blade to a disk, or to replace a serviced blade, the dovetail 30 of the blade is inserted into the associated slot 28 of the disk so that the blade hook 33 abuts the rim 35 of the disk (best illustrated in FIGS. 3 and 5). After seating the blade, the retainer 37 is positioned over the rim 35 and blade hook 33, the thrust member 40 being located between the guide members 49, retainer 37 and rim 35, as best illustrated in FIG. 3. A retaining bolt 56 is then axially inserted through the retainer 37 and thrust member 40 so that it engages the aperture 36 of the rim 35. In tightening the retaining bolt 56, the guide members 49 previously described are brought into contact with the rim 35 of the disk so that the blade hook 33 is secured between the bearing member 38 of the retainer 37 and the rim 35 of the disk, with the thrust member 40 being slidingly retained between the bearing member 38, the guide members 49 and the rim 35. By properly sizing the thrust member 40, it is possible to tighten the retainer 37 against the rim 35, retaining the blade hook 33 in position as shown, while permitting the thrust member 40 to slide within the cavity 51 in response to adjustment of the bolt 43. In this manner, the bolt 43 is used to develop a radially outwardly directed force which, through the thrust member 40, is applied against the surface 47 of the blade hook 33. Upon achieving proper loading, the locking nut 48 is tightened against the base portion 39 of the retainer 37, assisting the self-locking insert 42 in maintaining the adjustment.

The radially outwardly directed force which is applied against the surface 47 of the blade hook 33 forces the base 29 of the blade 7 radially outwardly, with reference to FIG. 5, developing contact areas 75, 76, 77, 78 between the dovetail 30 and slot 28. In this manner, the clearance 74 developed between the dovetail 30 of the blade and the slot 28 of the disk is accommodated, preventing unwanted motion of the blade with respect to the disk and thereby ameliorating the effects of windmilling.

It will therefore be seen that the present invention serves well to satisfy each of the objectives previously set forth. It will also be understood that the present invention is capable of variation. For example, as previously mentioned, the illustrative example described above merely refers to one application of the present invention, it being understood that the present invention is also useful in conjunction with other types of blades used in other stages of the turbomachine, as well as with blades having other configurations.

For example, with reference to FIG. 6, it may be seen that the present invention may be used in connection with blades which do not have a blade hook 33 as illustrated in FIGS. 1–5. Rather, the blade 60 illustrated in FIG. 6 has a base 61 which substitutes a flat bottom 62 for the blade hook 33 previously described. The remaining structure of the blade 60 is essentially the same as the blade 7 illustrated in FIGS. 1–5. The retaining means and associated structure are also essentially the same as previously described, however, the thrust member 65 has been extended so that the upper edge 66 of the thrust member 65 is capable of contacting the bottom 62 of the base 61 of the blade 60. Installation of the blade 60, and use of the retaining means of the present invention, proceeds substantially as previously described.

Further, although the foregoing describes aft retention of a blade to a disk, it will be understood that the present invention may be used to provide forward blade retention as well.

It is also possible to develop a retainer 37 which does not incorporate guide members 49 of the type illustrated in FIGS. 3–5, or which uses discrete pegs or tabs in their place.

Lastly, it will be understood that a variety of different devices may be used in place of the bolts 43, 56, depending upon convenience and the environment in which they are to be used.

Accordingly, an invention has been described for reducing the harmful effects of windmilling upon fan blades in a gas turbine aircraft engine. The windmilling occurs chiefly when the aircraft is parked on the ground and the engine is not in operation. During this time, the fan blades ordinarily fit loosely in slots in a rotor of the engine and the windmilling causes the rotor to rotate and, consequently, the blades clatter or clank within their slots, causing wear. The present invention reduces the clanking by applying an axially directed force to the dovetail 30 by means of the bearing portion 38 (FIG. 3) and by applying a radially directed force to the bottom 62 (FIG. 6) of the blade or to a blade hook 32 (FIG. 3).

The axial force retains the blade axially within the slot and the radial force pushes the blade dovetail radially outward into the slot. When engine operation is begun, centrifugal force loads the blades and gradually overcomes the effects of the present invention so that, during flight, the effects of centrifugal force dominate over the forces applied by the present invention. Results of the centrifugal force include the radially outward expansion of rotating components, with the accompanying radial displacement of the blade dovetails. Thus, a small radial shifting of the dovetail 30 with respect to the bearing portion 38 can be expected. When the engine is slowed, the centrifugal loading relaxes, so that the dovetail 30 can return to its original position with respect to the bearing portion 38. It is not intended that the clamping provided by the present invention overcome the effects of centrifugal loading. Rather, the present invention provides clamping of the blades into their slots during windmilling when the engine is not operational.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. For use in turbomachinery of the type including a rotatable disk with at least one slot at its periphery and a blade radially retained to said disk, said blade having a base including a dovetail portion and a hook portion depending therefrom, said slot and said dovetail portion having correspondingly configured surfaces for slidingly retaining said dovetail portion within said slot, and said hook portion extending radially inwardly from an edge of the base of said blade and along lateral portions of said disk, means for reducing relative motion between said blade and said disk comprising retaining means operatively associated with said lateral portions of said disk and adapted to retain said hook means adjacent said lateral portions of said disk, and adjustment means operatively associated with said retaining means and adapted to apply a substantially radially outwardly directed force against said hook means.

2. The structure of claim 1 wherein said hook portion depends from the rearmost edge of said blade.

3. The structure of claim 1 wherein said adjustment means only applies a substantially radially outwardly directed force against said hook portion.

4. The structure of claim 1 wherein said retaining means further comprises a retainer member having base and bearing portions, said bearing portion overlying said hook portion and said lateral portions of said disk and said base portion forming an angle with said bearing portion and extending generally toward said disk, and axial retaining means extending between said bearing portion of said retainer member and said lateral portions of said disk, and adapted to retain said hook portion in position between said lateral portions of said disk and said bearing portion of said retainer member; and wherein said adjustment means further comprises an adjustment member engaging said base portion and extending toward said hook portion, and a thrust member slidingly retained between said bearing portion of said retainer member and said lateral portions of said disk, and between said adjustment member and said hook portion; whereby adjustment of said adjustment member forces said thrust member into contact with said hook portion.

5. The structure of claim 4 wherein said adjustment means further comprises means for locking said adjustment member in a selected position.

6. The structure of claim 5 wherein said locking means is a self-locking insert associated with said base portion.

7. The structure of claim 4 wherein said retainer member further comprises guide members depending from opposing lateral edges of said bearing portion and extending generally toward said lateral portions of said disk.

8. The structure of claim 7 wherein said thrust member is located between said guide members.

9. The structure of claim 8 wherein said guide members contact said lateral portions of said disk and said thrust member is slidingly retained between said retainer member and said disk.

10. The structure of claim 4 wherein said thrust member has a centrally disposed, elongated slot for receiving said axial retaining means therein.

11. The structure of claim 4 wherein said thrust member includes depressed central portions defining a radius therein.

12. The structure of claim 1 wherein said bearing portion and said base portion are separated by approximately 90°.

13. The structure of claim 1 wherein said means for preventing relative motion reduces angular displacement of said blade with respect to said disk.

14. For use in turbomachinery of the type including a rotatable disk with at least one slot at its periphery and a blade radially retained to said disk, said blade having a base including a dovetail portion depending therefrom, and said slot and said dovetail portion have correspondingly configured surfaces for slidingly retaining said dovetail portion within said slot, means for reducing relative motion between said blade and said disk comprising retaining means operatively associated with lateral portions of said disk and adapted to retain the dovetail portion of said blade within the slot of said disk, and adjustment means operatively associated with said retaining means and adapted to apply a substantially radially outwardly directed force against the base of said blade.

15. Apparatus for clamping a fan blade having a blade hook into a slot in a rotor in a gas turbine engine when the engine is not in operation, comprising:

(a) means for applying an axially directed force to the blade hook for retaining the hook against the rotor and (b) means for applying a radially directed force to the blade hook for clamping the blade into the slot.

16. A method for reducing relative motion between a disk associated with a turbomachine and a blade associated with said disk, said disk having at least one shaped slot at its periphery, said blade having a base including shaped portions engaging said slot, and said method comprising the steps of:

(a) providing retaining means adapted to retain said shaped base portions within said slot and including adjustment means operatively associated therewith;

(b) positioning said retaining means adjacent said disk and overlying portions of said base and said slot;

(c) attaching said retaining means to said disk so that said adjustment means is capable of contacting and applying a substantially radially outwardly directed force against said base; and (d) varying said outwardly directed force by adjusting said adjustment means, forcing said shaped base portions into contact with said shaped slot.

17. The method of claim 16 further comprising the step of locking said adjustment means in position after said adjusting.

18. In a method of operating a gas turbine engine having fan blades which are engaged in slots in a rotor and which engine is associated with an aircraft, the improvement comprising:

applying a combination of at least two forces in at least two different directions to some of the fan blades for reducing motion of blades within their slots, the combination of forces being insufficiently strong to prevent displacement of the blades resulting from centrifugal force during flight of the aircraft.

19. A method of operating a gas turbine aircraft engine having fan blades loosely engaged in slots in a rotor, comprising the following steps:

(a) clamping the blades into their slots for reducing the effects of on-ground windmilling;

(b) overcoming the clamping of (a) by centrifugal force during engine operation;

(c) reestablishing the clamping of (a) following the cessation of engine operation.

* * * * *